US006555516B1

(12) United States Patent
Brook et al.

(10) Patent No.: US 6,555,516 B1
(45) Date of Patent: Apr. 29, 2003

(54) LAUNDRY PRODUCT

(75) Inventors: Dawn Brook, Wirral (GB); Robert John Crawford, Wirral (GB); Paul Ferguson, Wirral (GB); Philip John Sams, Wirral (GB)

(73) Assignee: Unilever Home & Personal Care USA, division of Conopco,, Greenwich, CT (US)

( * ) Notice: Subject to any disclaimer, the term of this patent is extended or adjusted under 35 U.S.C. 154(b) by 48 days.

(21) Appl. No.: 09/721,113

(22) Filed: Nov. 27, 2000

(30) Foreign Application Priority Data

Nov. 25, 1999 (GB) ..... 9927901

(51) Int. Cl.[7] ..... C11D 3/37
(52) U.S. Cl. ..... 510/475
(58) Field of Search ..... 510/445, 475

(56) References Cited

U.S. PATENT DOCUMENTS

| | | | | |
|---|---|---|---|---|
| 5,591,377 | A | 1/1997 | Nickel et al. | |
| 6,187,842 | B1 * | 2/2001 | Kobayashi et al. | 524/58 |
| 6,265,368 | B1 * | 7/2001 | Aronson et al. | 510/403 |
| 6,329,331 | B1 * | 12/2001 | Aronson et al. | 510/158 |

FOREIGN PATENT DOCUMENTS

| | | | |
|---|---|---|---|
| EP | 0 598 335 | | 5/1994 |
| GB | 731396 | A | 6/1955 |
| GB | 2 179 053 | | 2/1987 |
| GB | 2179053 | A | 2/1987 |
| GB | 2184452 | A | 6/1987 |
| GB | 2272450 | A | 5/1994 |
| GB | 2280450 | A | 2/1995 |
| GB | 2 280 682 | | 2/1995 |
| GB | 2280682 | A | 2/1995 |
| GB | 2280906 | A | 2/1995 |
| GB | 2327949 | A | 2/1999 |
| WO | 9114766 | A | 10/1991 |
| WO | 9829530 | A | 7/1998 |
| WO | 99/06519 | | 2/1999 |
| WO | 99/24550 | | 5/1999 |

OTHER PUBLICATIONS

International Cosmetic Ingredient Dictionary and Handbook, 7th ed., 1997, J. A. Wenninger, G. N. McEwen, Ed., p. 1089.*

International Search Report PCT EP/ 00/10288 dated Feb. 8, 2001, 3 pp.;.

Great Britian Search Report GB 9927901.0 dated Feb. 21, 2000, 1 pg.

* cited by examiner

*Primary Examiner*—John Hardee
(74) *Attorney, Agent, or Firm*—Alan A. Bornstein

(57) ABSTRACT

Product adapted for use in a fabric laundering process which is in the form of a self-supporting aqueous gel and which comprises one or more fabric treatment agents, a gelling agent and one or more surfactants comprising a polypeptide or polysaccharide.

13 Claims, No Drawings

LAUNDRY PRODUCT

This invention relates to a product adapted for use in a fabric laundering process, to a process for producing the product, to a method of treating fabric using the product and to the use of the product in the treatment of fabric as part of a domestic laundering process.

Some laundry products, including main wash detergent compositions and fabric conditioning compositions, which are often in the form of liquids or powders, can have problems associated with their handling. The provision of such products, particularly main wash detergent compositions, in a pre-dosed form (such as tablets) can overcome these problems.

Providing a product in a pre-dosed form overcomes the problems of spillage of powders and liquids. It also makes it easy for the consumer to use the correct amount of the product by avoiding the needing to measure out the product.

Hexagonal phased gets also disclosed in GB2179053, GB2280450 and GB2280682.

A multi-phase detergent tablet containing a compressed granular detergent mixture and a gelatinous portion is disclosed in WO 99/24550. The gelling agent for the gelatinous portion is a caster oil derivative or polyethylene glycol, preferably the latter. There is no suggestion that the gelatinous portion could be used without the compressed granular detergent mixture. Furthermore, the gelatinous portion is non-aqueous and, indeed, may contain a drying agent.

Detergent compositions which are described as being gels are disclosed in U.S. Pat. No. 5,591,377 and WO99/06519. However, the gels are pourable, having a defined viscosity, and are not self-supporting.

EP-A-0598335 teaches a surfactant gel in which the gel is formed by the surfactant itself, as a surfactant VI phase, there being no separate requirement for a gelling agent. Thus, the properties of the gels are confined within the boundaries of compounds that are effective surfactants and can form a surfactant VI phase. Furthermore, the compositions clearly must contain the surfactant in order to be gelled and, therefore, the range of product types which can be formed according to this teaching is limited to compositions which may contain a substantial amount of surfactant. The compositions disclosed in this reference preferably have a melting point above 40° C.

There exists a need for alternative laundry products which can be readily handled and which can be produced in pre-dosed form. The present invention addresses this need.

The present invention also aims to provide a laundry product which can be used in a variety of different applications in the laundry area.

It is a further object of the present invention to provide a laundry product, which is readily dispersible and/or soluble in aqueous laundry media used in fabric laundering processes.

According to the present invention, there is provided a product adapted for use in a fabric laundering process which is in the form of a self-supporting aqueous gel and which comprises one or more fabric treatment agents, including, one or more surfactants comprising a polypeptide or polysaccharide and a gelling agent.

In another aspect, the invention provides a process for producing the product of the invention which comprises dissolving the gelling agent in an aqueous liquid, optionally at an elevated temperature, and allowing or causing the solution of the gelling agent thus formed to gel.

A further aspect of the invention is a method of treating fabric, as part of a laundering process, which comprises applying to the fabric a fabric treatment agent using the product of the invention.

Yet another aspect of the invention is the use of the product of the invention in the treatment of fabric as part of a laundering process.

The product of the invention is preferably in a pre-dosed form, such as unit or sub-unit dosage form, such that one or another whole number of doses of the product is used at the appropriate stage of a given fabric laundering process. The product may take any suitable shape, irregular or regular, including spherical, pyramidal and cubic forms. The product may be of any suitable size to accommodate sufficient fabric treatment agent for the particular step of the fabric laundering process in which it is used. The product may have a maximum dimension within the range of about 1 cm to about 5 cm, although products having sizes outside this range may also be used. The product is self-supporting (ie, it supports its own weight when placed on a flat surface, showing no noticeable flow over a time period of a few minutes) and may be readily handled, especially at the point of use.

The product may comprise a coating of a water-soluble polymer, such as of polyvinyl alcohol, for example, to improve handling of the product even further. This can be a particular advantage when the product itself has a sticky or otherwise potentially undesirable consistency.

The product can be transparent and may be coloured or colourless. Coloured products can be prepared by including conventional dyes in the product or by using fabric treatment agents which are coloured. The product can have a single phase or can comprise suspended liquid and/or solid particles and/or gas bubbles. Multi-phase systems of this type can have an aesthetic appeal to the domestic user. However, suspended liquid and/or solid particles may also have a beneficial effect, such as acting as fabric treatment agents themselves e.g., to enhance cleaning efficiency.

The product of the invention may take the form of discrete individual unit doses. Alternative product forms include pre-formed bars or blocks from which unit doses can be broken off by hand or by cutting.

The product may be used at any stage of a fabric laundering process, including in the pre-wash, main wash, rinse cycle (e.g., as a rinse conditioner or a rinse adjunct), post-rinse and/or in the tumble dryer. For a number of these applications, it may be desirable for the product to have a gel melting point of below 40° C. in order to aid its dissolution and/or dispersion into the liquor and/or the fabric and this is particularly so for products adapted for use in the main wash cycle or in the tumble dryer.

The gelling agent, which is used in the product of the invention, comprises a polypeptide or polysaccharide. Suitable polypeptide gelling agents include gelatin (from animal or non-animal sources). Polysaccharide gelling agents are well known, particularly in the food industry, and include, for example, locust bean gum and xanthan gum. The gelling agent may be used singly or as a mixture of gelling agents and may require a further substance to effect gelation, such as a metal cation. The gelling agent preferably has a gel melting point of below 40° C. Products of the invention which contain a gelling agent having a gel melting point of below 40° C. have the advantage of being readily dispersed and/or dissolved in the wash water when fabric is washed at 40° C., a conventional temperature setting on many automatic washing machines. If the product is to be used in other applications, however, the gel melting point of the gelling agent may be higher. For example, higher gel melting points may be suitable for products used in a tumble drier (in which the temperature can reach 85° C.) and lower gel melting points may be suitable for products, which need to disperse and/or dissolve in cold water.

The strength of the gel in the product of the invention can be modified not only by the selection of an appropriate gelling agent but also by varying the concentration of the gelling agent and the amount of additives it contains. Thus, the dispersibility of the product of the invention can be modified by decreasing the amount of gelling agent in the product. Preferably, the product of the invention comprises from 1 to 30% by weight of the gelling agent, more preferably from 1 to 20% by weight. The dispersibility of the product can also be modified by incorporating one or more dispersant agents into the product.

The product of the invention is an aqueous gel and preferably comprises from 10 to 90% by weight water, more preferably from 20% to 70% by weight water. Aqueous systems can dissolve readily in aqueous laundry media, do not add solvents to the media and can give an interesting feel to the product.

The fabric treatment agents, which may be used in the product of the invention, include detergent active compounds (including surfactants), fabric softening and/or conditioning compounds and other compounds (including polymers and resins) which can impart benefits to fabric. Hence, the fabric treatment agent may impart benefits including one or more of cleaning, softening, conditioning, improving handling, improving overall appearance and reducing shrinkage. The nature of the fabric treatment agent may be dictated by the stage of the laundering process at which the product is intended to be used.

If the product of the invention is to be used in a laundry process as part of a conventional fabric treatment product, such as a detergent composition, the fabric treatment agent will typically comprise a detergent-active compound. Whereas, if the product is a rinse conditioner, the fabric treatment agent will comprise a fabric softening and/or conditioning compound.

If the product of the invention is to be used before, or after, the laundry process it may be in the form of a spray or foaming product.

If the product of the present invention is in the form of a detergent composition, the fabric treatment agent may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred fabric treatment agents that can be used are soaps and synthetic non-soap anionic and nonionic compounds.

Anionic surfactants are well known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the product is suitably from 0.1 to 60 wt % e.g. 0.5–55 wt %, such as 5–50 wt %.

Preferably, the quantity of anionic surfactant (when present) is in the range of from 1 to 50% by weight of the total product. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The products may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5\ M_2O.\ Al_2O_3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

If the product of the present invention is in the form of a fabric conditioner composition, the fabric treatment agent will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the products are considered dilute, or at levels from 8% to about 50% by weight, in which case the products are considered concentrates.

Products suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric-softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337). Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

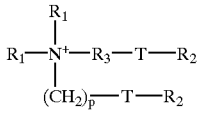

(II)

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $R_3$ is a linear or branched alkylene group of 1 to 5 carbon atoms, T is

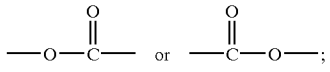

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

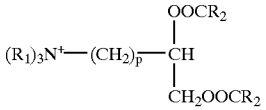

(III)

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The products may alternatively or additionally contain water-soluble cationic fabric softeners, as described in GB 2 039 556B (Unilever).

The products may comprise a cationic fabric softening compound and an oil, for example as disclosed in EP-A-0829531.

The products may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The products may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The products can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and non-ionic surfactants.

The fabric conditioning compositions may also include an agent which produces a pearlescent appearance, e.g. an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes (which are compatible with the gelling agent), optical brightening agents, opacifiers, dye transfer inhibitors, anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The fabric treatment agent, which is used in the product of the invention, may be a polymer or resin which imparts benefits to the fabric. The resin can be a resin, which is capable of self cross-linking and/or of reacting with cellulosic fibres. The resin can be cationic, anionic or amphoteric. The gelled product of the invention may enhance the stability of compositions, which contain reactive resins of this type. Exemplary resins include polyamines, such as polyaminoamide-epichlorohydrin resins as disclosed in WO 98/29530, for example, polyethyleneimines, such as described in WO 97/42289, for example, and carbamoylsulphonate-terminated poly(ether)urethane resins as disclosed in GB-A-2005322, for example. The disclosures in the latter three documents are incorporated by reference herein.

The process of the invention for producing the product of the invention comprises dissolving the gelling agent in an aqueous liquid, optionally at an elevated temperature, and allowing or causing the solution of the gelling agent thus formed to gel.

Where the gelling agent, which is used in the process of the invention, is gelatin, the dissolution of the gelling agent may require an elevated temperature e.g., above 35° C. For other gelling agents, elevating the temperature above ambient temperature may be not required for dissolution of the gelling agent.

The solution which is formed in the process of the invention may be allowed to gel (e.g., by standing) or caused to gel e.g., by cooling to room temperature, where an elevated temperature is used, or by adding a component which is required for the gelling agent to gel (such as a metal ion). Suitable conditions for causing or allowing the gel to form will be known to those skilled in the art.

The one or more fabric treatment agents may be incorporated into the process at any stage prior to formation of the gel. Thus, for example, the gelling agent may be dissolved in an aqueous solution comprising the one or more fabric treatment agents or the gelling agent may first be dissolved in water or another aqueous liquid to form a solution, and the one or more fabric treatment agents may then be added to the solution.

The following non-limiting examples illustrate the invention.

EXAMPLES

Method for Gelatine Based Products (Examples 1 to 4)

Demineralised water was poured into a glass beaker and heated using a thermostatic hotplate. When the water had reached a minimum of 80° C., the gelatine (Sigma) was added.

The water/gelatine mixture was stirred by hand until all crystals were dissolved. The mixture was left to cool to a minimum of 40° C. before adding the fabric treatment agent (e.g., PAE resin or surfactant). Patent blue dye (C. I. Food Blue 5 (42051), BASF) was then added and stirred thoroughly to give a uniform colour. The mixture was added to a mould and left to cool.

The gelled products of Examples 1 to 4 were prepared using the general method described above.

All percentages are percentages by weight.

The PAE resin used in the examples was Kenores 1440 (trade mark) (Akzo Nobel).

Example 1

A gelled product was prepared from the following components.

12.6 g gelatin (13.5%)

50.4 g demineralised water (54%)

30 g PAE resin (32%)

1 ml blue dye

The product dissolved in 2 min 3 s at 40° C.

Example 2

A gelled product was prepared from the following components.

13.03 g gelatin (9%)

100 g demineralised water (69%)

30 g PAE resin (20%)

1 ml blue dye

The product dissolved in 1 min 8 s at 40° C.

Example 3

A gelled product was prepared from the following components.

12 g gelatin (10%)

50.7 g demineralised water (40%)

60 g PAE resin (50%)

1 ml blue dye

The product dissolved in 1 min 6 s at 40° C.

Example 4

A gelled product was prepared from the following components.

12.8 g gelatin (9.5%)

103 g demineralised water (70%)

6.44 g Neodol (trade mark) (4.7%)

12.8 g Na PAS (9.5%)

The product dissolved in 2 min 20 s at 40° C.

Example 5

A gelled product was prepared from the following components.

10 g locust bean gum (Luxara 5831, Arthur Branwell+Co. Ltd)

100 g demineralised water (cold)

30 g PAE resin 1 ml blue dye 100 g of cold water was added to 10 g-locust bean gum and stirred until mixed thoroughly. 30 g PAE was then added to the gum mixture and finally the patent blue dye was added.

The locust bean gum produced a translucent, self-supporting gel with a grainy texture.

What is claimed is:

1. A method of treating fabric as part of a laundering process which comprises applying to the fabric a product in the form of a self-supporting aqueous gel wherein said product includes one or more fabric treatment agents, a gelling agent and one or more surfactants comprising a polypeptide or polysaccharide.

2. The method as claimed in claim 1, wherein the gelling agent is gelatin.

3. The method as claimed in claim 1, wherein the product has a gel melting point of below 40° C.

4. The method as claimed in claim 3, which comprises the gelling agent in an amount of from about 1 to 20% by weight.

5. The method as claimed in claim 1, wherein the one or more fabric treatment agents comprise a detergent active compound.

6. The method as claimed in claim 1, wherein the one or more fabric treatment agents comprise a fabric softening compound.

7. The method as claimed in claim 1, wherein the one or more fabric treatment agents comprises a resin.

8. The method as claimed in claim 7, wherein the resin is a cationic polymer.

9. The method as claimed in claim 8, wherein the resin is a polyamine-epichlorohydrin resin.

10. The method as claimed in claim 7, wherein the resin is an anionic polymer.

11. The method as claimed in claim 1, wherein the product is in unit or sub-unit dosage form.

12. The method as claimed in claim 1, wherein the product is coated with a water soluble polymer.

13. A product adapted for use in a fabric laundering process which is in the form of a self-supporting aqueous gel, which comprises: one or more fabric treatment agents; a gelling agent; one or more surfactants including a polypeptide or polysaccharide; and wherein the one or more fabric treatment agents includes a resin, wherein the gelling agent is gelatin, which has a gel melting point of below 40° C. and is present in an amount of from 1 to 20% by weight;

wherein the one or more fabric treatment agents comprises a detergent active compound or a fabric softening compound; and wherein the resin is a polyamine-epichlorohydrin resin or an anionic polymer.

* * * * *